US010655927B2

(12) United States Patent
Simonds et al.

(10) Patent No.: US 10,655,927 B2
(45) Date of Patent: May 19, 2020

(54) ARCHERY BOW STABILIZER

(71) Applicant: MCP IP, LLC, Sparta, WI (US)

(72) Inventors: Jon Simonds, Gainesville, FL (US); Gary L. Simonds, Gainesville, FL (US)

(73) Assignee: MCP IP, LLC, Sparta, WI (US)

( * ) Notice: Subject to any disclaimer, the term of this patent is extended or adjusted under 35 U.S.C. 154(b) by 15 days.

(21) Appl. No.: 14/701,132

(22) Filed: Apr. 30, 2015

(65) Prior Publication Data

US 2015/0316343 A1 Nov. 5, 2015

Related U.S. Application Data

(60) Provisional application No. 61/986,801, filed on Apr. 30, 2014.

(51) Int. Cl.
*F41B 5/14* (2006.01)

(52) U.S. Cl.
CPC ..... *F41B 5/1426* (2013.01)

(58) Field of Classification Search
CPC ..... F41B 5/1426; F41B 5/14; F41B 5/066; F41B 5/1453
See application file for complete search history.

(56) References Cited

U.S. PATENT DOCUMENTS 2,516,172 A 7/1950 Baldwin
3,149,541 A 9/1964 Flutter et al.
3,342,172 A 9/1967 Sanders
3,412,725 A 11/1968 Hoyt, Jr.
3,416,508 A 12/1968 Thompson
3,524,441 A 8/1970 Jeffery
3,628,520 A 12/1971 Izuta
3,670,712 A 6/1972 Izuta
3,683,534 A 8/1972 Davis
3,683,883 A 8/1972 Izuta
3,841,295 A 10/1974 Hunter
3,854,467 A 12/1974 Hofmeister
3,958,551 A 5/1976 Ketchum
3,993,039 A 11/1976 Groves et al.
4,005,858 A 2/1977 Lochner
4,011,929 A 3/1977 Jeram et al.
4,085,832 A 4/1978 Gaines et al.
4,150,819 A 4/1979 Taylor
4,245,612 A 1/1981 Finlay
4,279,091 A 7/1981 Edwards
4,310,149 A 1/1982 Camilleri
4,324,222 A 4/1982 Gasser
4,342,429 A 8/1982 Katoh et al.
4,372,285 A 2/1983 Simonds et al.
4,401,097 A 8/1983 Simonds et al.
4,438,753 A 3/1984 Simonds
(Continued)

OTHER PUBLICATIONS

Webpage for Toxonics Stabilizers from Feb. 4, 2005, available at http://web.archive.org/web/20050204152102/http://toxonics.com:80/stabilizers.html.

*Primary Examiner* — Alvin A Hunter
*Assistant Examiner* — Amir A Klayman

(57) ABSTRACT

A bow stabilizer that reduces bow shock transmitted to archer's hand includes a plurality of weights disposed about a central shaft. An elastomeric material supports the weights and couples the weights to the central shaft. The central shaft is connected to the frame of the bow. Bow vibration is damped as the central shaft vibrates out of phase with the suspended weights.

19 Claims, 6 Drawing Sheets

(56) References Cited

U.S. PATENT DOCUMENTS

| | | | | |
|---|---|---|---|---|
| 4,440,142 | A | 4/1984 | Simonds | |
| 4,458,657 | A | 7/1984 | Stockmar | |
| 4,461,267 | A | 7/1984 | Simonds et al. | |
| 4,478,203 | A | 10/1984 | Hayes | |
| 4,478,204 | A | 10/1984 | Kocsan | |
| 4,491,123 | A | 1/1985 | Wirtz | |
| 4,512,326 | A | 4/1985 | Jarrett | |
| 4,570,608 | A | 2/1986 | Mastertield | |
| 4,615,327 | A | 10/1986 | Saunders | |
| 4,632,228 | A | 12/1986 | Oster et al. | |
| 4,660,536 | A | 4/1987 | McPherson | |
| 4,660,538 | A | 4/1987 | Burgard | |
| 4,706,788 | A | 11/1987 | Inman et al. | |
| 4,718,647 | A | 1/1988 | Ludwig | |
| 4,779,602 | A | 10/1988 | Hess, Sr. | |
| 4,827,894 | A | 5/1989 | Schallberger | |
| 4,838,236 | A | 6/1989 | Kudlacek | |
| 4,893,606 | A | 1/1990 | Sisko | |
| 4,909,231 | A | 3/1990 | Larson | |
| 4,945,666 | A | 8/1990 | Henry | |
| 4,982,719 | A | 1/1991 | Haggard et al. | |
| 4,986,018 | A | 1/1991 | McDonald | |
| 4,993,399 | A | 2/1991 | Chattin | |
| 5,005,554 | A | 4/1991 | Shepley et al. | |
| 5,016,602 | A | 5/1991 | Mizek | |
| 5,040,520 | A | 8/1991 | Nurney | |
| 5,044,351 | A | 9/1991 | Pfeifer | |
| D331,614 | S | 12/1992 | Martin et al. | |
| 5,174,268 | A | 12/1992 | Martin et al. | |
| 5,273,022 | A | 12/1993 | Leven | |
| 5,307,787 | A | 5/1994 | LaBorde et al. | |
| 5,339,793 | A | 8/1994 | Findley | |
| 5,362,046 | A | 11/1994 | Sims | |
| 5,368,006 | A | 11/1994 | McPherson | |
| 5,370,104 | A | 12/1994 | Neie | |
| 5,385,136 | A | 1/1995 | Thomas | |
| 5,388,563 | A | 2/1995 | Hsu | |
| 5,390,656 | A | 2/1995 | Villa et al. | |
| 5,411,009 | A | 5/1995 | Thompson et al. | |
| 5,460,156 | A | 10/1995 | Sappington | |
| 5,495,843 | A | 3/1996 | Larson | |
| 5,505,185 | A | 4/1996 | Miller | |
| 5,511,533 | A | 4/1996 | Waller | |
| 5,513,622 | A | 5/1996 | Musacchia, Sr. | |
| 5,515,836 | A | 5/1996 | Martin et al. | |
| 5,595,168 | A | 1/1997 | Martin | |
| 5,595,169 | A | 1/1997 | Brown, Jr. | |
| 5,611,325 | A | 3/1997 | Kudlacek | |
| 5,613,484 | A | 3/1997 | Troncoso | |
| 5,638,804 | A | 6/1997 | Remick et al. | |
| 5,657,741 | A | 8/1997 | Todd | |
| 5,669,370 | A | 9/1997 | Breedlove | |
| 5,678,529 | A | 10/1997 | Larson | |
| 5,735,257 | A | 4/1998 | Walk | |
| 5,762,060 | A | 6/1998 | Larson | |
| 5,782,229 | A | 7/1998 | Evans et al. | |
| 5,809,982 | A | 9/1998 | McPherson | |
| 5,934,265 | A | 8/1999 | Darlington | |
| 5,934,266 | A | 8/1999 | Martin et al. | |
| 5,937,843 | A | 8/1999 | Troncoso | |
| 5,975,070 | A | 11/1999 | Sands | |
| 5,992,403 | A | 11/1999 | Slates | |
| 6,021,770 | A | 2/2000 | Sodaro | |
| 6,085,736 | A | 7/2000 | Osterhues | |
| 6,092,516 | A | 7/2000 | Martin et al. | |
| 6,105,564 | A | 8/2000 | Suppan | |
| 6,179,510 | B1 | 1/2001 | Meicke et al. | |
| 6,298,842 | B1 | 10/2001 | Sims | |
| 6,382,201 | B1 * | 5/2002 | McPherson | F41B 5/0005 124/23.1 |
| 6,526,957 | B1 | 3/2003 | Leven | |
| 6,588,414 | B2 | 7/2003 | McMillan, III | |
| 6,675,793 | B1 | 1/2004 | Saunders | |
| 6,712,059 | B2 | 3/2004 | Donovan | |
| 6,718,964 | B1 | 4/2004 | Graf | |
| 6,817,352 | B1 | 11/2004 | Saunders | |
| 7,290,644 | B2 | 11/2007 | Miyake | |
| 7,318,430 | B2 * | 1/2008 | Leven | F41B 5/1426 124/89 |
| 7,793,645 | B2 | 9/2010 | Walk et al. | |
| 7,954,481 | B2 | 6/2011 | Barnard | |
| 8,038,133 | B2 | 10/2011 | McPherson | |
| 8,141,548 | B2 | 3/2012 | Leven | |
| 8,166,963 | B2 | 5/2012 | Leven | |
| 8,225,778 | B2 | 7/2012 | Walk et al. | |
| 8,573,193 | B2 | 11/2013 | Khoshnood | |
| 8,590,522 | B2 | 11/2013 | Khoshnood | |
| 8,833,356 | B2 | 9/2014 | Khoshnood | |
| 2002/0014231 | A1 * | 2/2002 | Pujos | F41B 5/1426 124/89 |
| 2002/0020403 | A1 | 2/2002 | Troubridge | |
| 2002/0104526 | A1 | 8/2002 | Chipman | |
| 2002/0162547 | A1 | 11/2002 | McMillan, III | |
| 2003/0094168 | A1 | 5/2003 | Sims | |
| 2003/0226556 | A1 | 12/2003 | Leven | |
| 2004/0107952 | A1 | 6/2004 | Kronfeld | |
| 2006/0180135 | A1 | 8/2006 | Andrews | |
| 2006/0283435 | A1 | 12/2006 | Pellerite | |
| 2008/0264400 | A1 | 10/2008 | Wright | |
| 2009/0133683 | A1 | 5/2009 | Wright | |
| 2010/0031946 | A1 * | 2/2010 | LoRocco | F41B 5/1426 124/89 |
| 2010/0242940 | A1 * | 9/2010 | Leven | F41B 5/1426 124/89 |
| 2011/0120439 | A1 * | 5/2011 | Leven | F41B 5/1426 124/89 |
| 2011/0120440 | A1 | 5/2011 | Stokes | |
| 2011/0259313 | A1 | 10/2011 | Reinhold | |
| 2012/0125308 | A1 | 5/2012 | Khoshnood | |
| 2012/0125309 | A1 | 5/2012 | Khoshnood | |
| 2012/0125310 | A1 * | 5/2012 | Khoshnood | F41B 5/1426 124/89 |
| 2012/0240913 | A1 * | 9/2012 | Stokes | F41B 5/1426 124/89 |
| 2013/0118468 | A1 * | 5/2013 | Kozlik | F41B 5/1426 124/89 |

* cited by examiner

ARCHERY BOW STABILIZER

CROSS-REFERENCE TO RELATED APPLICATIONS

This application claims the benefit of U.S. Provisional Application No. 61/986,801, filed Apr. 30, 2014, the entire content of which is hereby incorporated herein by reference.

FIELD OF THE INVENTION

The present invention relates generally to archery bows, and more particularly to archery bow stabilizers and bows comprising a stabilizer.

BACKGROUND OF THE INVENTION

Archery bows and bow stabilizers are known in the art. Stabilizers perform multiple functions including balancing the weight of the bow, stabilizing the bow during aiming and reducing shock and vibration after an arrow is fired.

With respect to stabilization, a stabilizer adds mass. There is a general desire for a bow to be as light as possible. A greater amount of mass generally provides for better stabilization, so there is a compromise between weight and stabilization performance.

With respect to vibration damping, a stabilizer can include an elastomeric portion that allows the stabilizer to damp vibrations, for example as disclosed in U.S. Pat. No. 6,802,307. Stabilizers that provide vibration damping typically provide effective damping across a limited frequency range, which is less than the entire range of vibrations present in an archery bow.

There remains a need for stabilizers having novel designs, which provide better combinations of stabilization, relatively low weight and vibration damping.

Without limiting the scope of the invention a brief summary of some of the claimed embodiments of the invention are set forth below. Additional details of the summarized embodiments of the invention and/or additional embodiments of the invention may be found in the Detailed Description of the Invention below.

All US patents and applications and all other published documents mentioned anywhere in this application are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The present invention is directed in one or more embodiments to archery bow stabilizers that utilize a suspended mass damper to reduce bow vibrations.

In some embodiments, an archery bow stabilizer comprises a body member configured for attachment to an archery bow and a suspended mass that surrounds the body member. A resilient member is supported by the body member and the suspended mass is supported by the resilient member. Deformation of the resilient member allows the suspended mass to move with respect to the body member.

In some embodiments, an archery bow stabilizer comprises one or more weights arranged to surround a central shaft. The weights are suspended by an elastomeric coupling, which comprises one or more elastomeric members. In some embodiments, the suspended mass comprises a plurality of weights that are interconnected with one another. In some embodiments, multiple bow stabilizers are configured to be attached to one another. In at least one embodiment, the suspended-mass assembly can be variably positioned along the central shaft and reversibly held in place by means of a set screw. In at least one embodiment of the invention the central shaft is fitted with detents that engage and retain an elastomeric or resilient member.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention. Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

A detailed description of the invention is hereafter described with specific reference being made to the drawings.

DETAILED DESCRIPTION OF THE INVENTION

Figure 1:
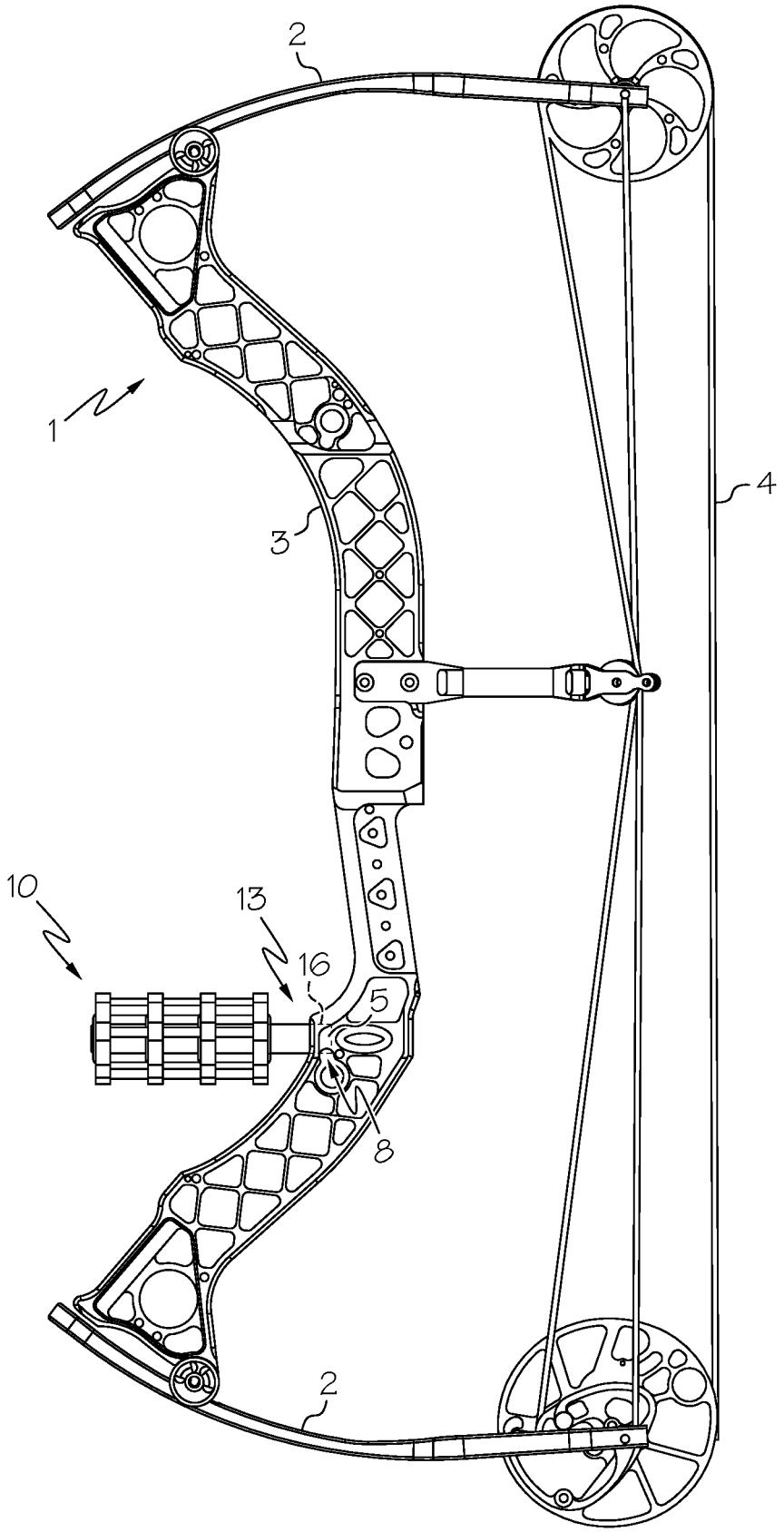
FIG. 1 shows a side view of an embodiment of a bow stabilizer attached to an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated. As used in this specification describing a bow stabilizer, the terms distal and proximal should be understood as being used with respect to a support location for the stabilizer—for example, a portion of the stabilizer configured for attachment to an archery bow. The term "proximal" means closer to the support location, whereas the term "distal" means farther from the support location.

FIG. 1 shows an embodiment of an archery bow 1 and an embodiment of an archery bow stabilizer 10. In some embodiments, an archery bow 1 comprises a riser 3, opposed limbs 2 and a bowstring 4. Desirably, the riser 3 comprises a grip 6. In some embodiments, the riser 3 is provided with a stabilizer mounting location 8 arranged to support a stabilizer 10 using any suitable method. For example, in some embodiments, the stabilizer mounting location 8 comprises a threaded receptacle 5. In some embodiments, the stabilizer 10 comprises a threaded protrusion 16, such as a shaft, that attaches to the threaded receptacle 5. In some embodiments, a threaded protrusion 16 is located at a proximal end 13 of the stabilizer 10.

Figure 2:
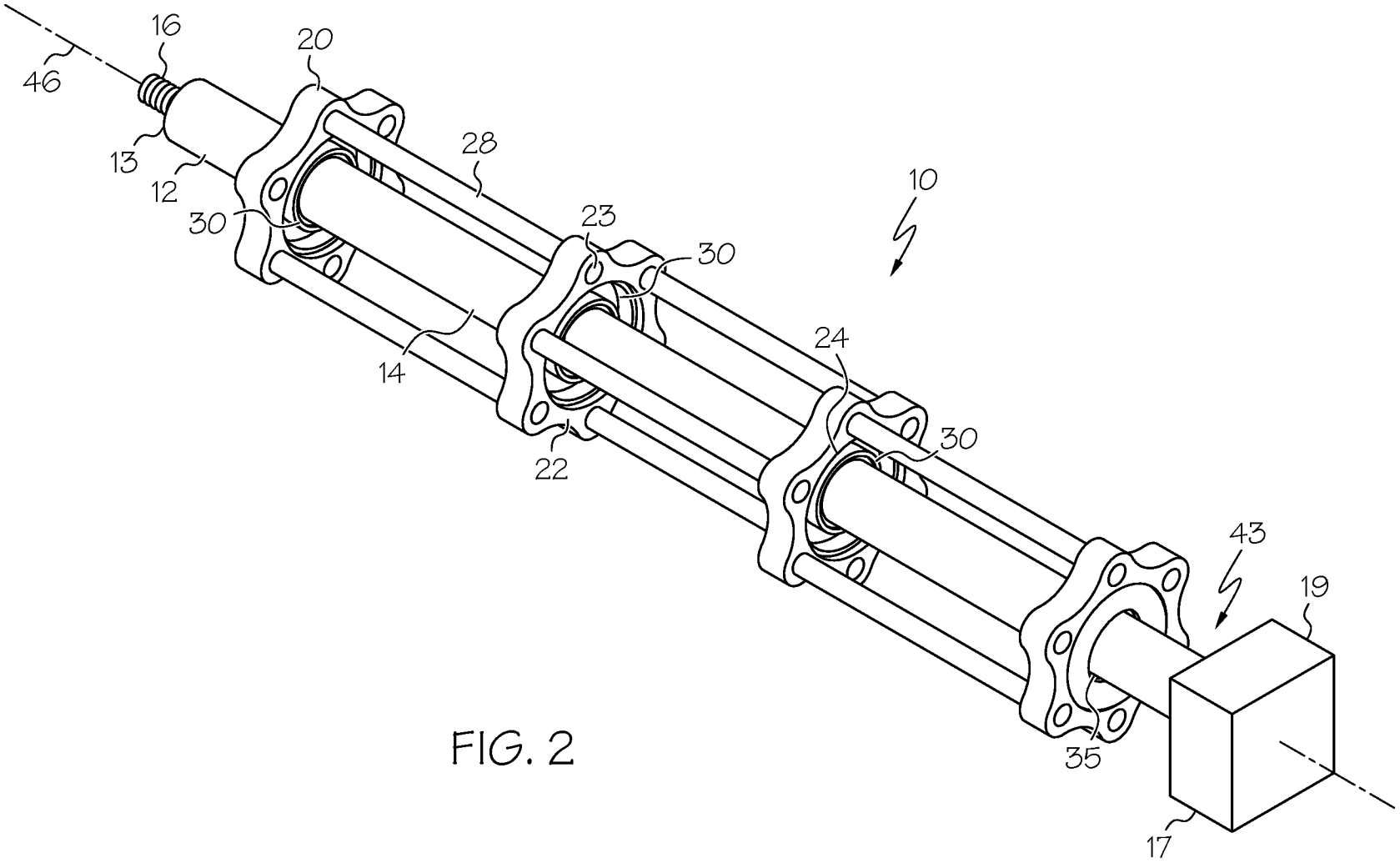
FIG. 2 shows an embodiment of a bow stabilizer.
Figure 3:
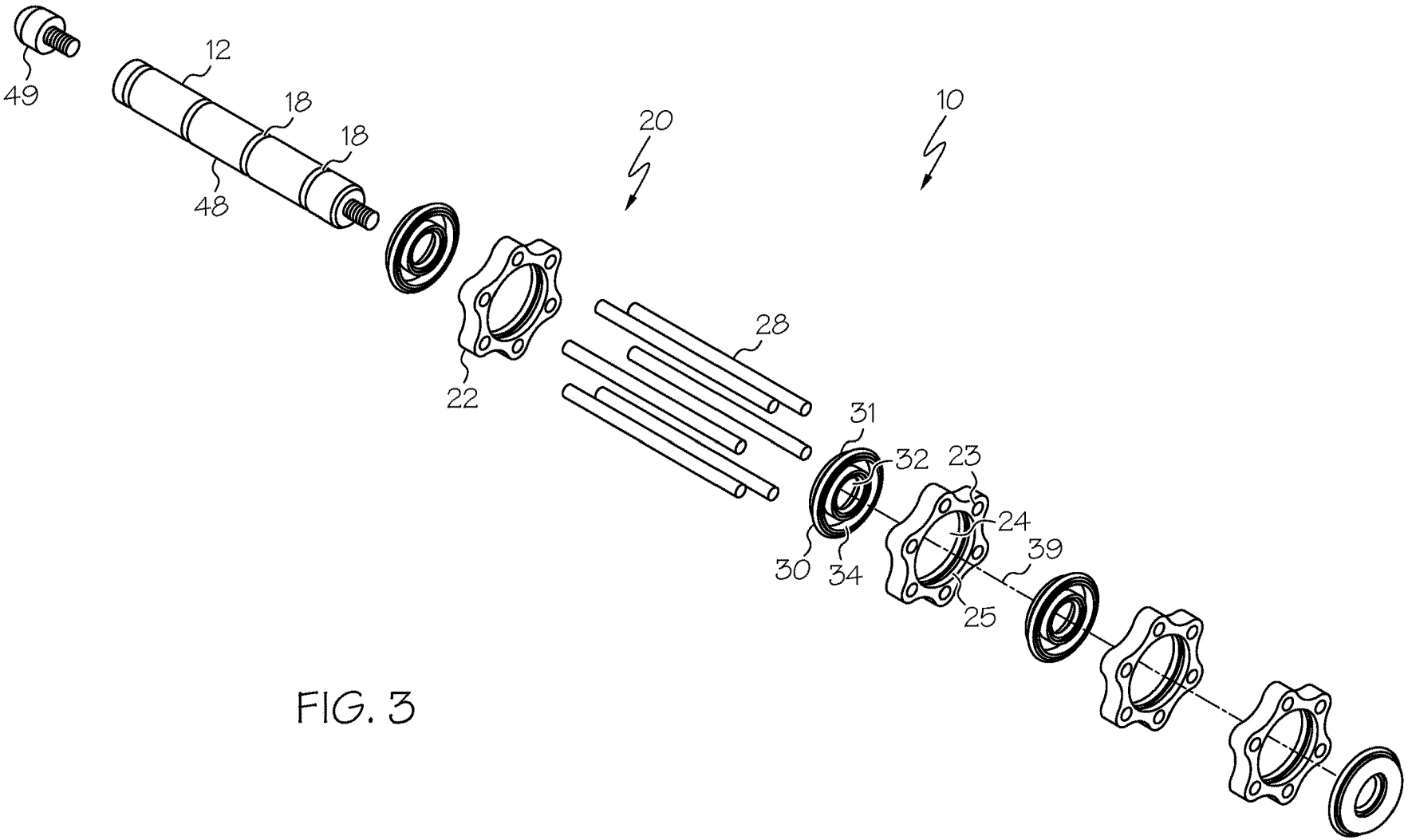
FIG. 3 shows an exploded view of an embodiment of a stabilizer.

FIG. 2 shows an embodiment of an archery bow stabilizer 10. FIG. 3 shows an exploded view of an embodiment of an archery bow stabilizer 10. Desirably, the stabilizer 10 comprises a body member 12 configured for attachment to an archery bow. In some embodiments, the body member 12 comprises a threaded shaft 16. Desirably, the stabilizer 10 comprises at least one resilient member 30 that is supported by the body member 12. Desirably, the stabilizer 10 comprises a suspended mass 20 that is supported by the at least one resilient member 30. Desirably, the at least one resilient member 30 comprises a material having greater amount of elastic deformability than either the body member 12 or the suspended mass 20. In some embodiments, the at least one resilient member 30 comprises a natural rubber, a synthetic rubber, butyl rubber, an elastomer, a silicone, neoprene, a viscoelastic urethane polymer, various recognized damping materials such as suitable thermoplastics and vinyls, etc.

In some embodiments, a stabilizer 10 comprises a plurality of resilient members 30, wherein the plurality of resilient members 30 collectively support the suspended mass 20.

The resiliently suspended mass 20 functions as a vibration damper that will damp vibrations in the bow 1. Various embodiments of a suspended mass 20 can have any suitable size, shape and mass, and various embodiments of the at least one resilient member 30 can have any suitable amount of deformability. The specifics of the suspended mass 20 and the at least one resilient member 30 can be adjusted to provide a stabilizer 10 having a desired frequency damping and a desired overall weight.

Desirably, at least a portion of the suspended mass 20 surrounds the body member 12. This configuration allows the suspended mass 20 to be greater in weight than prior stabilizers have provided. In some embodiments, the suspended mass 20 comprises a plurality of weight members 22 that are spaced from one another and attached by at least one connector 28. In some embodiments, a weight member 22 surrounds the body portion 12, forming a closed loop. In some embodiments, a central axis of a weight member 22 is coaxial with a central axis 46 of the body member 12. In some embodiments, adjacent weight members 22 are connected by a plurality of connectors 28. In some embodiments, the connectors 28 are evenly spaced around the body member 12. In some embodiments, a weight member 22 comprises one or more apertures 23. In some embodiments, a connector 28 is received in an aperture 23. In some embodiments, a connector 28 extends through an aperture 23 and extends on first and second sides of a weight member 22.

A weight member 22 is attached to a connector 28 using any suitable method. In some embodiments, a weight member 22 is welded to a connector 28. In some embodiments, a connector 28 is press fit/interference fit into a weight member 22. In some embodiments, an adhesive is used. In some embodiments, a weight member 22 is attached to a connector 28 using a fastener. In some embodiments, a connector 28 is threaded into a weight member 22.

Various portions of the suspended mass 20 can be formed from any suitable material and desirably comprise a relatively heavy or dense material. In some embodiments, a suspended mass 20 comprises one or more metals such as steel, aluminum, lead, tungsten, brass, zinc, suitable alloys and combinations thereof, etc.

A weight member 22 can have any suitable size, shape and mass, and can be similar to one another or different from one another. In some embodiments, multiple weight members 22 each have a similar size, shape and mass. In some embodiments, a first weight member 22 comprises a size, shape and/or mass that is different from a second weight member 22.

A connector 28 can have any suitable size, shape and mass. In some embodiments, a connector 28 comprises a rod, such as a solid rod or a tubular member. In some embodiments, a connector 28 comprises a tube having uniform wall thickness. In some embodiments, a connector 28 comprises a circular cross-sectional shape. In some embodiments, a connector 28 comprises a material similar to that of a weight member 22.

In some embodiments, a weight of the suspended mass 20 is greater than a weight of the body member 12.

In some embodiments, a weight member 22 comprises an aperture 24 configured to receive a resilient member 30. In some embodiments, the aperture 24 is centered in the weight member 22. In some embodiments, a weight member 22 is mounted upon a resilient member 30. In some embodiments, a resilient member 30 is provided for each weight member 22, and each weight member 22 is mounted upon a resilient member 30.

A resilient member 30 can have any suitable size, shape and mass, and desirably resiliently suspends the mass member 20 with respect to the body member 12. In some embodiments, a stabilizer 10 comprises a plurality of resilient members 30. Multiple resilient members 30 can have a similar size, shape and mass, or can be different from one another.

Figure 4:
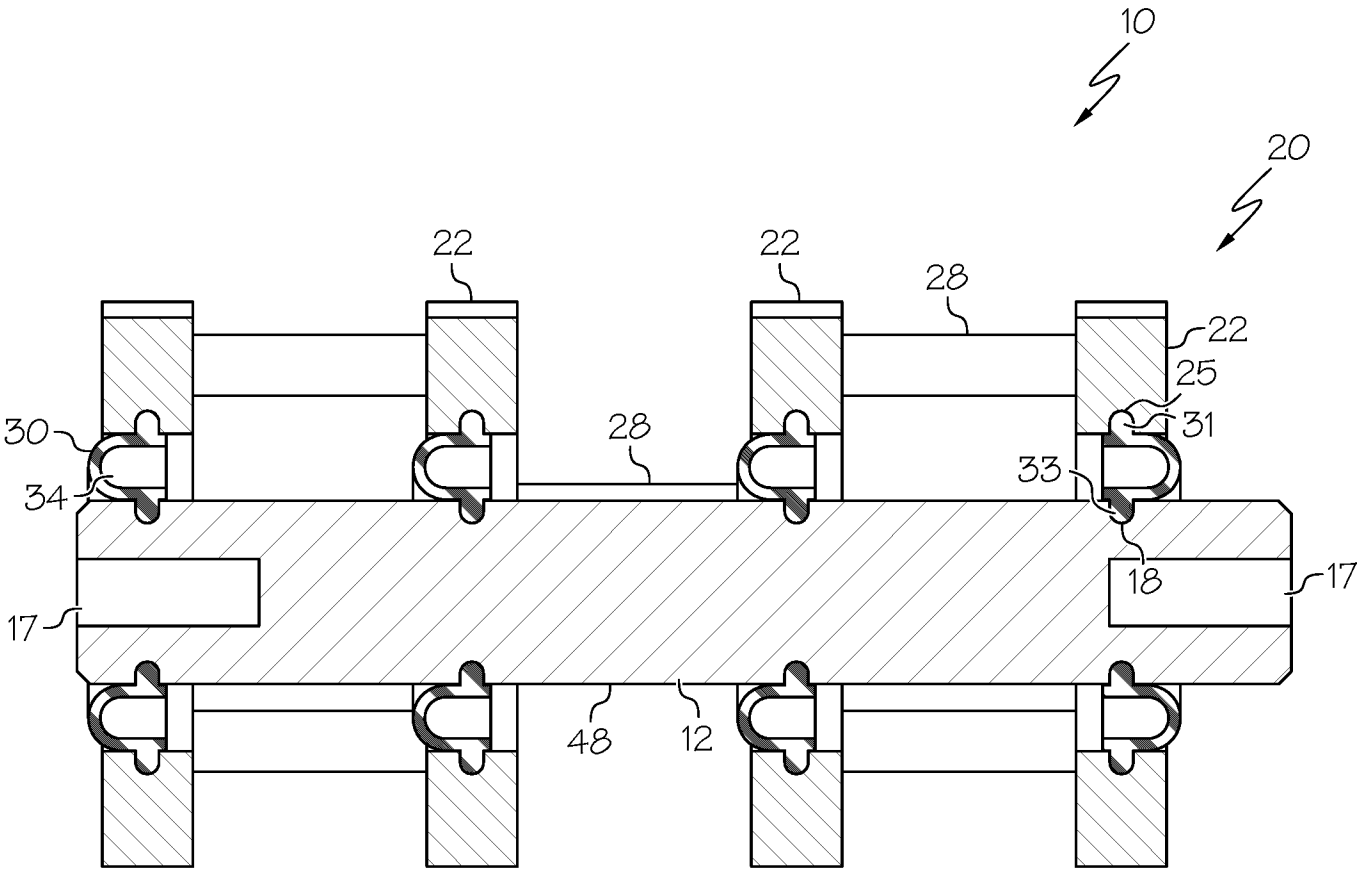
FIG. 4 shows a cross-sectional view of an embodiment of a stabilizer.

FIG. 4 shows a cross-sectional view of an embodiment of a stabilizer 10. With reference to FIGS. 3 and 4, in some embodiments, a resilient member 30 comprises an annular shape defining an aperture 32 and a central axis 39. In some embodiments, the aperture 32 is centered in the resilient member 30. In some embodiments, a resilient member 30 comprises an annular channel 34 that extends about (e.g. surrounds) the central axis 39. In some embodiments, the annular channel 34 comprises a U-shaped cross-section. The vertical axis of the U-shape may be oriented in a direction parallel to the central axis 39 of the resilient member 30. The shape of a resilient member 30, for example an annular channel 34, may provide compliance in directions parallel to the central axis 34, as well as compliance in directions perpendicular to the central axis 34. Thus, a mass 20 that is engaged with the resilient member 30 may move in three orthogonal directions with respect to the body member 12, including moving along an axial direction of the central axis 39.

Resilient members 30 can face any suitable direction. FIG. 4 shows an embodiment of a stabilizer 10 where the outermost resilient members 30 face opposite directions.

A resilient member 30 can be attached to the mass member 20 using any suitable method, such as fasteners, adhesives, friction/interference fit, etc. Similarly, a resilient member 30 can be attached to the body member 12 using any suitable method.

In some embodiments, a resilient member 30 and the mass member 20 comprise complimentary interlocking shapes. In some embodiments, a resilient member 30 and a weight member 20 comprise complimentary interlocking shapes. For example, in some embodiments, a weight member 22 comprises a recess, such as an annular groove 25, and a resilient member 30 comprises an annular protrusion 31. The protrusion 31 of the resilient member 30 is configured to engage the annular groove 25. In some embodiments, a weight member 22 comprises an annular protrusion and a resilient member 30 comprises an annular recess (not illustrated).

In some embodiments, a resilient member 30 and the body member 12 comprise complimentary interlocking shapes. For example, in some embodiments, body member 12 comprises a recess 18, such as an annular groove, and a resilient member 30 comprises an annular protrusion 33. The protrusion 33 of the resilient member 30 is configured to engage the recess 18. In some embodiments, a body member 12 comprises an annular protrusion and a resilient member 30 comprises an annular recess (not illustrated).

In some embodiments, the body member 12 is provided with a plurality of recesses 18, each arranged to secure a resilient member 30. In some embodiments, a resilient member 30 is secured to each recess 18, and a weight member 22 is provided for each resilient member 30.

In some embodiments, multiple recesses 18 are provided at fixed intervals (e.g. equal spacing) along a length of the body portion 12.

In some embodiments, the body member 12 comprises multiple pieces attached to one another. FIG. 4 shows an embodiment of a body member 12 that includes a threaded receptacle 17 at each end. The body member 12 can be attached to an archery bow using a threaded stud inserted into a threaded receptacle 17. In some embodiments, a body member 12 comprises a shaft 48 as shown in FIGS. 3 and 4, which may comprise threaded receptacles 17. In some embodiments, a body member 12 comprises multiple shafts 48 attached to one another. The number of shafts 48, and thus the length of the body member 12, a mass of the body member 12 and the number of recesses 18 can be adjusted as desired.

In some embodiments, a body member 12 comprises a mass attachment 49 attachable to a shaft 48. In some embodiments, a mass attachment 49 comprises a threaded stud arranged to be received in a threaded receptacle 17 of the shaft 48. A mass attachment 49 can be used to adjust the weight and shape of the body member 12, and/or the weight and shape of the stabilizer 10.

In some embodiments, a mass member 20 is attachable to the body member 12 in multiple configurations that will provide for different performance specifics. In some embodiments, a body member 12 comprises a plurality of detents, and the mass member 20 is moveable between detents. In some embodiments, detents comprise annular grooves 18.

In various embodiments, a mass member 20 can comprise any suitable configuration of weights 22 and/or connectors 28. A stabilizer 10 can further comprise multiple mass members 20, for example wherein a first mass member is not directly attached to a second mass member.

Figure 5:
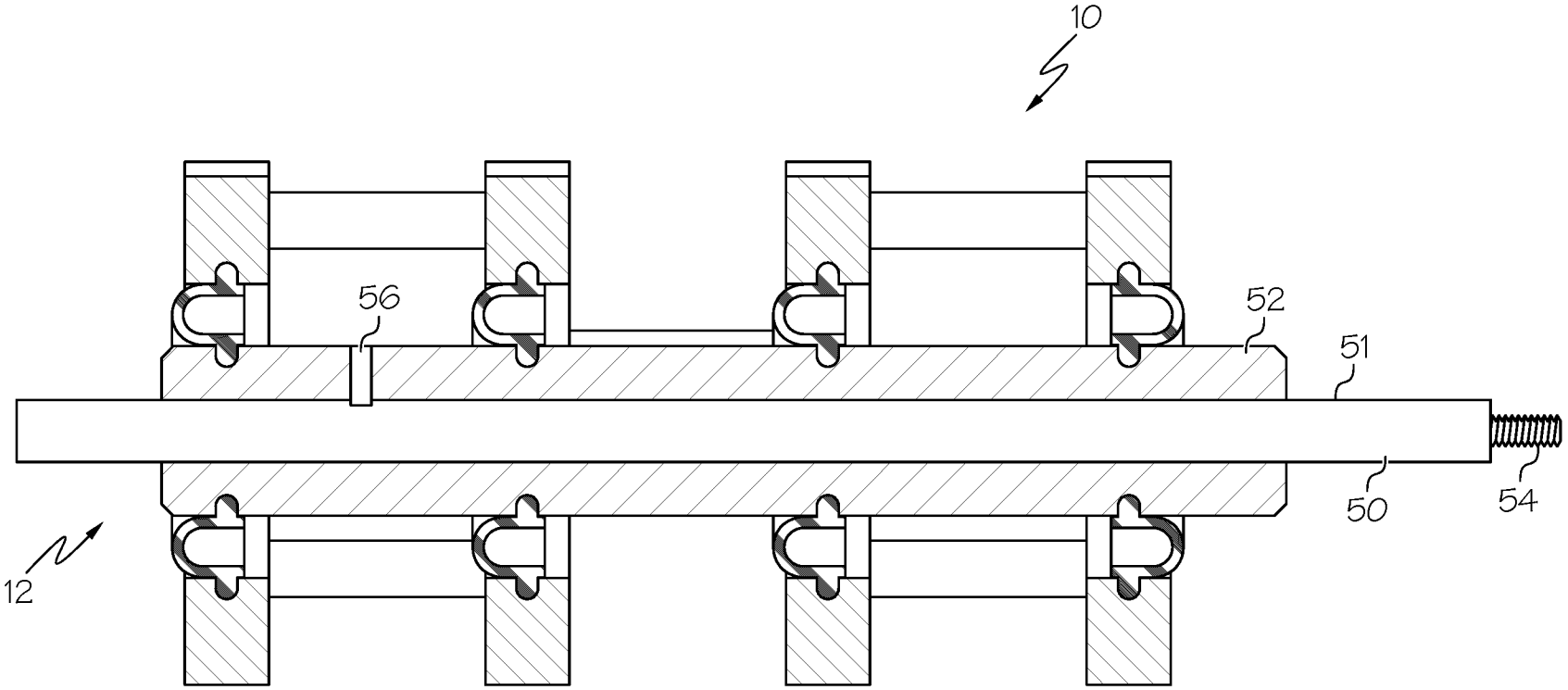
FIG. 5 shows a cross-sectional view of another embodiment of a stabilizer.

FIG. 5 shows another embodiment of a stabilizer 10. In some embodiments, a body portion 12 comprises a first portion 50 and a second portion 52. The first portion 50 is attachable to the second portion 52 in one of a plurality of orientations. In some embodiments, the first portion 50 is configured for attachment to a bow, for example comprising a threaded stud 54, and the second portion 52 is attachable to the first portion 50. In some embodiments, a fastener 56 is used to secure the second portion 52 to the first portion 50. In some embodiments, the first portion 50 comprises a plurality of detents or preset positions for the second portion 52.

In some embodiments, the first portion 50 of the body portion 12 comprises a shaft 51. In some embodiments, the second portion 52 is mountable upon the shaft 51. In some embodiments, the second portion 52 comprises a tube that surrounds the first portion 50. As shown in FIG. 5, the second portion 52 can be attached anywhere upon the shaft 51. Adjusting a position of the second portion 52 will change the specific shape of the stabilizer 10, thus changing its mass distribution. Adjusting a position of the second portion 52 will also move the location of the suspended mass 20 with respect to the bow, allowing for fine tuning adjustments.

Figure 6:
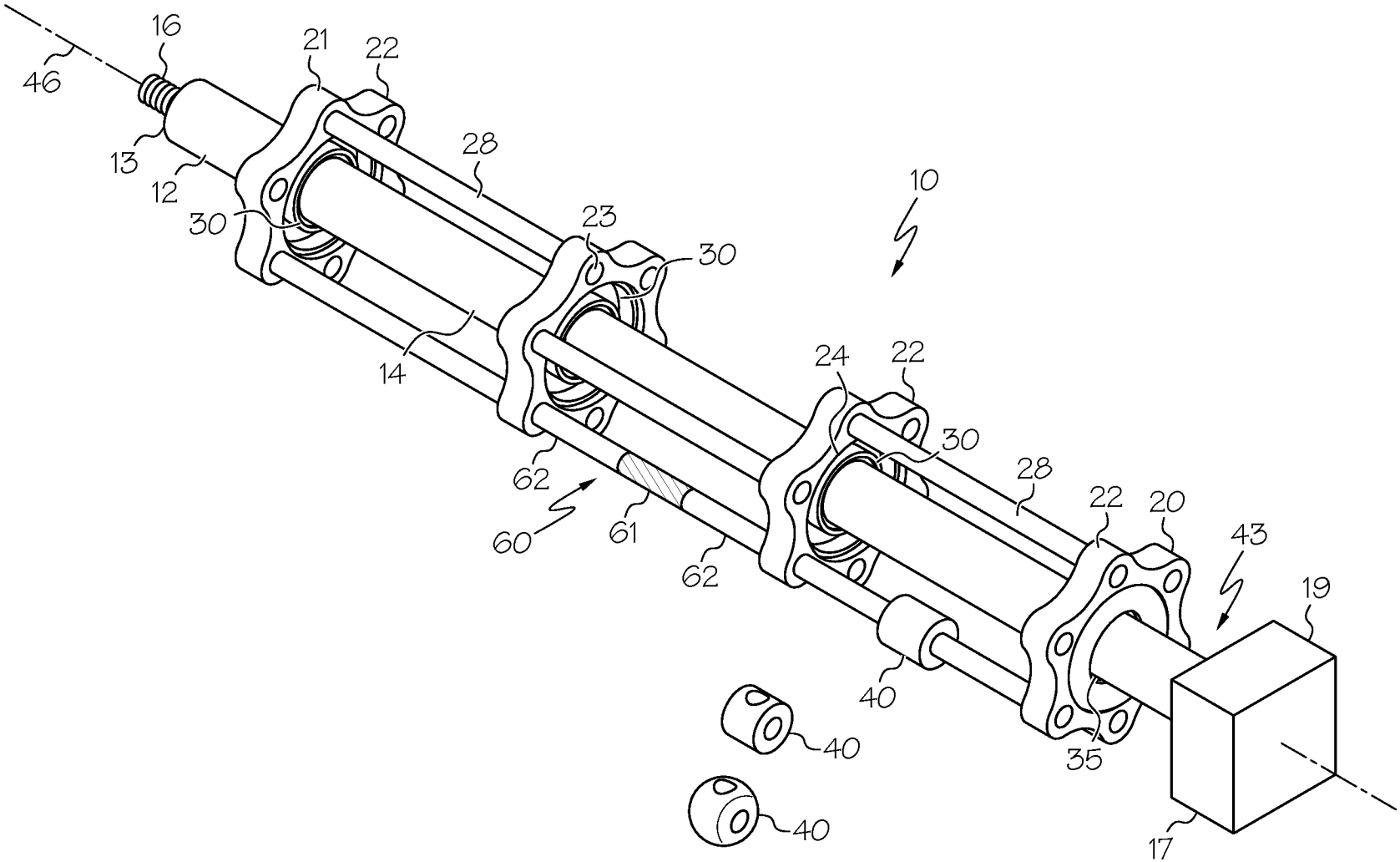
FIG. 6 shows another embodiment of a bow stabilizer.

FIG. 6 shows another embodiment of a stabilizer 10. In some embodiments, the mass 20 comprises one or more auxiliary weights 40. Desirably, an auxiliary weight 40 is attachable to the mass 20, for example being attached to a weight 22 or a connector 28. Auxiliary weights 40 can be attached to any suitable portion of the mass 20. Any suitable number of auxiliary weights 40 can be added at any suitable location. The number and placement of auxiliary weights 40 can be used to fine tune the damping characteristics of the stabilizer 10.

In various embodiments, the density of an auxiliary weight 40 can be equal to, less than or more than the density of another portion of the mass 20, such as a weight 22 or a connector 28.

In some embodiments, an auxiliary weight 40 is removably attached to a connector 28. In some embodiments, a connector 28 can comprise an integral auxiliary weight portion 40.

An auxiliary weight can have any suitable size and shape, and can be attached to the mass 20 using any suitable method.

FIG. 6 also shows an embodiment of a stabilizer 10 comprising a first suspended mass 20 and a second suspended mass 21. Desirably, the components that comprise the first suspended mass 20 are rigidly attached to one another, the components that comprise the second suspended mass 21 are rigidly attached to one another, but the first suspended mass 20 is not rigidly attached to the second suspended mass 21.

In some embodiments, the first suspended mass 20 is not directly connected to the second suspended mass 21.

In some embodiments, a connecting member 60 is arranged to connect the first suspended mass 20 to the second suspended mass 21. Desirably, the connecting member 60 comprises a resilient portion 61. The resilient portion 61 desirably comprises a highly elastically deformable material such as rubber, an elastomer or any other suitable material, for example a material disclosed herein as suitable for a resilient member 30. In some embodiments, a connecting member 60 comprises one or more rigid portions 62.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternative embodiments of the invention. Those skilled in the art may recognize other equivalents to the specific embodiment described herein which equivalents are intended to be encompassed by the claims attached hereto. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. An archery bow stabilizer comprising:

a body member configured for attachment to an archery bow riser, the body member comprising a first groove and a second groove;

a first resilient member supported by said body member, a portion of the first resilient member oriented in the first groove;

a second resilient member supported by said body member, a portion of the second resilient member oriented in the second groove; and a suspended mass supported by said first resilient member and said second resilient member, said suspended mass surrounding said body member, said suspended mass comprising a different material than said first resilient member.

2. The archery bow stabilizer of claim 1, said suspended mass comprising a first weight, a second weight and at least one connector attaching said first weight to said second weight, said first resilient member contacting said first weight, said second resilient member contacting said second weight.

3. The archery bow stabilizer of claim 2, wherein said first weight and said second weight have the same shape.

4. The archery bow stabilizer of claim 2, said first weight and said second weight attached by a plurality of connectors.

5. The archery bow stabilizer of claim 1, said body member further comprising a third groove, a spacing between said third groove and said second groove being similar to a spacing between said second groove and said first groove.

6. The archery bow stabilizer of claim 5, said stabilizer reconfigurable between first and second orientations, said first resilient member positioned in said first groove and said second resilient member positioned in said second groove in said first orientation, said first resilient member positioned in said second groove and said second resilient member positioned in said third groove in said second orientation, said suspended mass having a first position with respect to the body member in the first orientation and a second position with respect to the body member in the second orientation.

7. The archery bow stabilizer of claim 1, said suspended mass comprising a first suspended mass, said stabilizer further comprising at least one secondary resilient member supported by said body member and a second suspended mass supported by said at least one secondary resilient member, said first suspended mass not in contact with said second suspended mass.

8. The archery bow stabilizer of claim 7, said first suspended mass having a different weight than said second suspended mass.

9. The archery bow stabilizer of claim 7, further comprising a connecting member attached between said first suspended mass and said second suspended mass, said connecting member comprising an elastomeric material.

10. The archery bow stabilizer of claim 1, said body member comprising a first body portion and a second body portion, said second body portion moveable with respect to said first body portion between first and second positions.

11. The archery bow stabilizer of claim 10, wherein said first body portion is configured for attachment to an archery bow and said second body portion contacts said resilient member.

12. The archery bow stabilizer of claim 10, wherein at least a portion of said second body member surrounds said first body member.

13. The archery bow stabilizer of claim 10, wherein said second body member comprises a tubular structure.

14. The archery bow stabilizer of claim 10, comprising a fastener arranged to fix a position of said second body portion with respect to said first body portion.

15. The archery bow stabilizer of claim 1, said body member comprising threaded receptacle.

16. The archery bow stabilizer of claim 2, further comprising an auxiliary weight attached to said connector.

17. An archery bow stabilizer comprising:

a body member configured for attachment to an archery bow riser, the body member comprising an outer surface and an annular groove formed in the outer surface;

a resilient member supported by the body member, said resilient member surrounding the body member, said resilient member occupying the annular groove, said resilient member comprising a first material; and a suspended mass supported by the resilient member, said suspended mass comprising a second material different from said first material, the suspended mass surrounding the body member.

18. The archery stabilizer of claim 17, wherein the suspended mass surrounds the resilient member.

19. An archery bow stabilizer comprising:

a body member configured for attachment to an archery bow riser;

a first resilient member supported by said body member;

a second resilient member supported by said body member; and a suspended mass comprising a first weight, a second weight and a connector attaching the first weight to the second weight, the first weight supported by the first resilient member, the first weight surrounding the body member, the second weight supported by the second resilient member, the second weight surrounding the body member, a shape of the connector being different from a shape of the first weight and a shape of the second weight.

* * * * *